US006213887B1

(12) United States Patent
Carney

(10) Patent No.: US 6,213,887 B1
(45) Date of Patent: Apr. 10, 2001

(54) APPARATUS FOR PRACTICING THE GAME OF GOLF

(76) Inventor: William P. Carney, 4 High Ridge La., Oyster Bay, NY (US) 11771

( * ) Notice: Subject to any disclaimer, the term of this patent is extended or adjusted under 35 U.S.C. 154(b) by 279 days.

(21) Appl. No.: 08/659,359

(22) Filed: Jun. 6, 1996

(51) Int. Cl.[7] ..... A63B 69/36
(52) U.S. Cl. ..... 473/183; 473/220
(58) Field of Search ..... 473/320, 195, 473/183, 150

(56) References Cited

U.S. PATENT DOCUMENTS

| | | | | |
|---|---|---|---|---|
| 4,078,806 | | 3/1978 | Brandell | 273/179 A |
| 5,067,718 | | 11/1991 | Knox et al. | 273/185 R |
| 5,174,574 | | 12/1992 | Knox et al. | 273/179 B |
| 5,330,188 | | 7/1994 | Reiners | 273/181 R |
| 5,452,897 | * | 9/1995 | Mick | 473/220 |
| 5,472,204 | * | 12/1995 | English et al. | 473/220 |
| 5,527,041 | * | 6/1996 | Terry, III et al. | 473/150 |

* cited by examiner

*Primary Examiner*—Mark S. Graham

(57) ABSTRACT

A laser aiming device placed on a surface for practicing the game of golf is disclosed. The apparatus includes a housing simulating a generally circular golf hole for putting thereat, the surface for putting a golf ball thereon. A laser module emitting a laser beam is mounted adjacent the hole and projects the laser beam forwardly thereof providing an illuminated reference for aligning a putter with respect thereto, thus, enhancing the practice of putting.

13 Claims, 6 Drawing Sheets

APPARATUS FOR PRACTICING THE GAME OF GOLF

BACKGROUND OF THE INVENTION

1. Field of the Invention

This invention relates to apparatus for practicing the game of golf and more particularly to a target device which provides a laser beam enabling a user to properly aim and align the face of a putter thereby optimizing the practice of putting.

2. Description of Related Art

Apparatus employed by golfers for the practice of putting are well known in the art. A variety of target devices which simulate golf course holes are commercially available and offer golfers an opportunity to practice putting indoors. Such devices are usually placed on an adjacent floor that is covered by a carpet or other suitable material providing the golfer with a target and a surface upon which to practice putting without having to go out on a golf course.

Typically, simulated holes placed on carpeted floors are utilized to practice relatively short straight putts, for example, between one and ten feet. The correct execution of this type of putt necessitates proper club face alignment and proper club face speed. A successful short straight putt requires that the club face, at the moment of impact, is perpendicular to the intended path of the ball and that the club speed is sufficient to propel the ball to the hole. If the club face is not aligned perpendicularly to the intended path of the ball, the ball is directed either to the right or to the left of the hole depending on the golfer's alignment error. If the ball is not struck with the correct club head speed, the putt may not reach the hole because it is travelling too slowly or it may fly over the hole because it is travelling too quickly.

Club alignment is an eye-hand coordination skill that is usually enhanced by repeatedly aiming practice putts at the hole and by noting the actual directions of the attempted putts. Club head impact velocity is a matter of feel that may be perfected by a golfer judging the so called speed or condition of the putting surface and by observing the actual speed and/or distance of putted balls. When instructing correct club alignment to students on an actual grass practice green, some teaching professionals snap a carpenter's chalk line on the grass surface such that the line radiates from the target hole thereby marking an optimum path along which to aim practice putts. In addition, teaching professionals often use a flat ball marker pressed into the green to provide the student with a target spot lying on the optimum path of a successful putt. The student aims his or her practice putts at the spot, a technique which some players find improves their putting skills.

In order to optimize the practice of putting, it is generally accepted that a golfer train with his or her personal putter. The appearance of a properly aligned club face, the weight of the head and the feel of the club are important factors which influence the development of a successful and repeatable putting stroke. A substantial number of prior art training apparatus require that golfers affix various devices to their putters thereby effecting the feel and the appearance of the club. Therefore, it is desirable if golfers do not have to add any attachments to their putters while practicing putting.

As can be seen from the foregoing, there is a need for a putting practice apparatus which may be used indoors and outdoors and which provides not only a practice target hole but also a means by which to easily designate the optimum path of a successful putt. Further, as mentioned above, it is considered advantageous if the practice apparatus may be used without having to affix any devices to the player's personal putter.

The following United States Patents show prior art aiming systems to which the present invention is applicable:

U.S. Pat. No. 4,078,806 which issued on Mar. 14, 1978 to John R. Brandell discloses a golf practice apparatus embodying a target and a kicker for returning a ball to a person making a putt into the target. His apparatus also includes a mechanism for adjusting the force with which a ball is returned by the kicker. Brandell's disclosure does not solve the problem of providing a means by which to conveniently designate on the putting surface the optimum path of a successful putt aimed at the target, thus enhancing the practice of putting when using the device.

U.S. Pat. No. 5,067,718 which issued on Nov. 26, 1991 to J. Paul Knox et al discloses a golf putting target for receiving putted golf balls. LED's across the front of the target may be selectively energized to vary the target area. An infrared transmitter on one side of the target emits energy to two receivers located on the opposite side thereof, thereby providing a means by which a microprocessor mounted in the device calculates and displays the speed and direction of practice putts received therein. The disclosed device also includes an automatic ball return mechanism. However, the apparatus taught by Knox et al does not provide a means by which to easily mark a spot or a line on the playing surface enabling the user to visualize an optimum path of a successful putt aimed at the device.

U.S. Pat. No. 5,174,574, which issued on Dec. 29, 1992 to J. Paul Knox et al is a Division of U.S. Pat. No. 5,067,178, the disclosure of which is summarized above. Knox's divisional disclosure teaches substantially the same art as his parent patent which does not include a means enabling a user to visualize an optimum path of a successful putt.

U.S. Pat. No. 5,330,188 which issued on Jul. 19, 1994 to Eric W. Reimers discloses a putter alignment system which, in a first embodiment, includes a putter component and a target component. The putter component comprises a reflector affixed to the face of a user's putter and the target component includes an emitter generating an electromagnetic signal beam. To practice proper club face alignment, the user aims his or her putter, having the reflector mounted on the face thereof, at the target. The beam emitted by the target component is reflected back at the target by the reflector mounted on the impact surface of the user's putter. The location of the reflected beam is sensed by a receiver mounted on the target which detects the location of the reflected beam and displays its location by illuminating a light thereover. In a second embodiment, the putter component includes an emitter mounted on the head of the putter rather than on the target component. Reimer's patent does not solve the problem of providing a means by which to conveniently designate the optimum path of a successful putt aimed at the target hole thus enhancing the practice of putting when using the device. Further, Riemer's disclosure does not provide the player a practice apparatus which may be employed without having to add a device to his or her personal putter.

In summary, the prior art cited above has neither addressed nor solved the problem of providing the user an arrangement by which to easily mark on the playing surface the ideal line of a successful putt for optimizing the practice of putting.

SUMMARY OF THE INVENTION

The present invention overcomes the aforementioned problems and disadvantages and provides a putting practice apparatus which projects an illuminated reference line for enhancing the practice of putting.

In a first embodiment, a laser aiming device comprises a housing simulating a generally circular golf hole defining an axially extending diameter. The housing is positioned on an adjacent floor. The floor provides a surface for putting a golf ball thereon and the golf hole provides a target for putting thereto. The housing includes a bore wherein the axis of the bore lies in the vertical plane parallel to and passing through the diameter. A laser module mounted in the bore is adapted to emit a laser beam coincident with the axis thereof. The laser beam projects an illuminated mark on the surface forwardly of the target thereby providing a reference means defining an optimum path of a successful putt aimed at the target.

In a second embodiment, a laser aiming device is removably affixed to a putting apparatus. The apparatus simulates a generally circular golf hole defining an axially extending diameter. The apparatus is positioned on a surface for putting thereon and the golf hole provides a target for putting thereto. The laser aiming device comprises a casing forming a bore therein and a laser module is mounted in the bore. The laser module is adapted to emit a laser beam coincident with the axis of the bore. The device also comprises a base including means for removably affixing the base to the apparatus. The casing is adjustably mounted on the base providing means for adjusting the laser beam in the vertical plane parallel to and passing through the diameter so that the beam may be projected onto the surface at selected distances forwardly of the apparatus along the line formed by the intersection of the vertical plane and the surface. The beam provides a reference means defining an optimum path of a successful putt aimed at the target.

In a third embodiment, an apparatus providing means for practicing proper alignment of a face of a putter with respect to an optimum path of a properly impacted golf ball comprises a target placed on a surface for putting thereon. The target simulates a golf hole for putting thereto. A laser emitter is positioned adjacent the target and projects a laser beam forwardly thereof. The laser beam defines an illuminated reference line for aligning the putter with respect thereto. The golf ball to be putted is placed on the path and the face of the putter is positioned adjacent the golf ball. The face is aligned perpendicularly to the reference line such that a properly aimed putt rolls along the reference line toward the target.

DETAILED DESCRIPTION OF THE INVENTION

Figure 1:
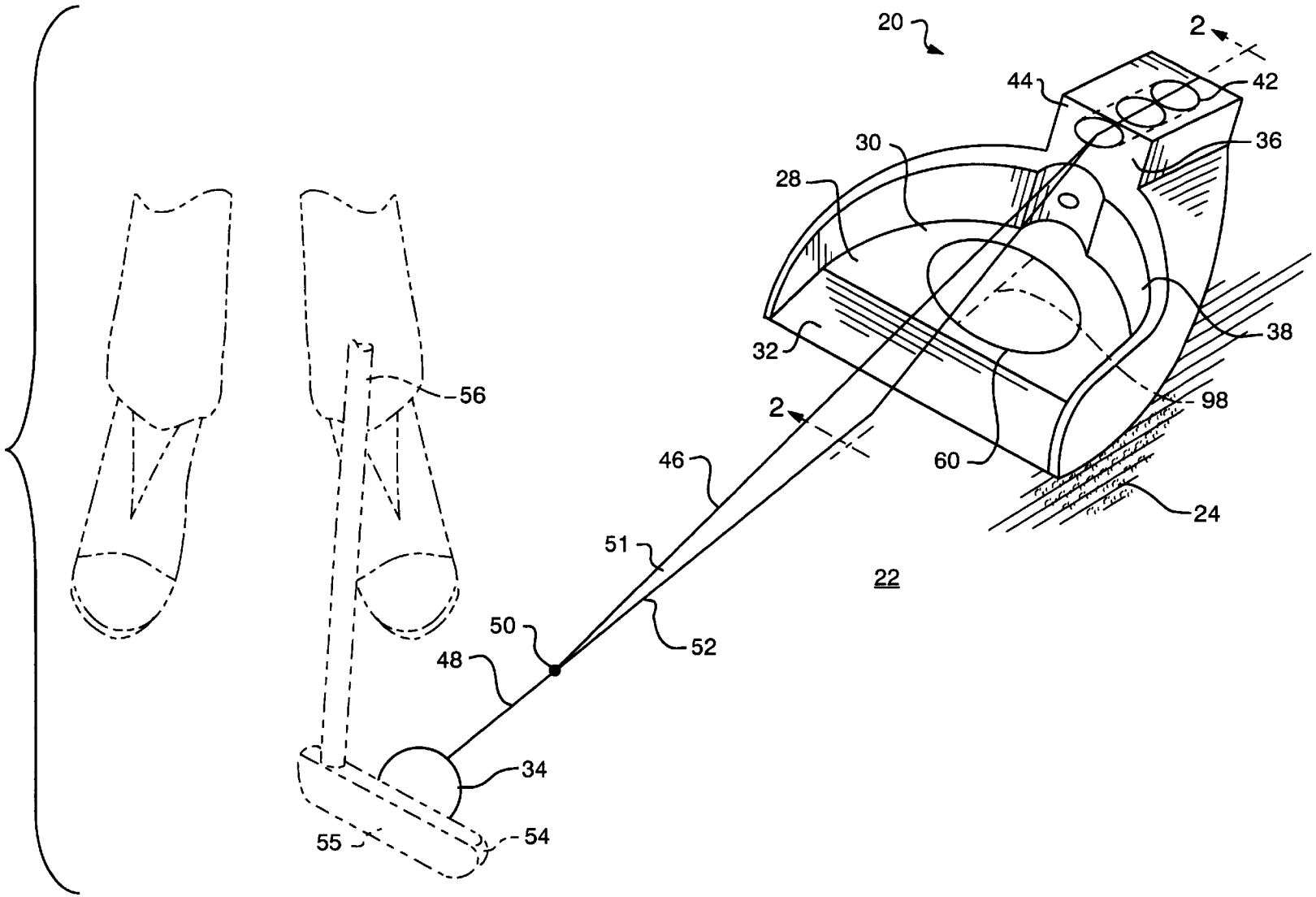
FIG. 1 is a front perspective view of an embodiment of the present invention employed by a golfer for the practice of putting.

Turning now to the drawings, there is shown in FIG. 1 a first embodiment of the present invention comprising a device generally referred to by reference number 20 employed by a golfer for the practice of putting. Placed on an adjacent floor 22 usually covered by carpeting 24 or other suitable material for putting thereon, the device 20 includes a target portion 28 defining a golf hole 30, a front ramp portion 32 over which a golf ball 34 travels from the carpeting 24 to the target portion 28 and a rear portion 36 which provides a backstop 38 to prevent a practice putt from rolling past the device 20. Also included in the rear portion 36 is a bore 42 mounting a laser module 44 therein.

As will be explained in more detail below, the laser module 44 may be selectively adapted by a user to emit either a laser beam 46 projecting an illuminated spot 50 on the surface 24 or a thin vertical plane of light 51 projecting an illuminated line 52 on the surface 24 enabling the user to visualize an optimum path 48 of a successful putt. The user practices putting by positioning the golf ball 34 on the path 48 and by employing either the illuminated spot 50 or the illuminated line 52 as a visual reference by which to align a face 54 on a head 55 of a putter 56 perpendicularly to the path 48 such that a successful putt is aimed along the path 48 toward the hole 30.

Figure 2:
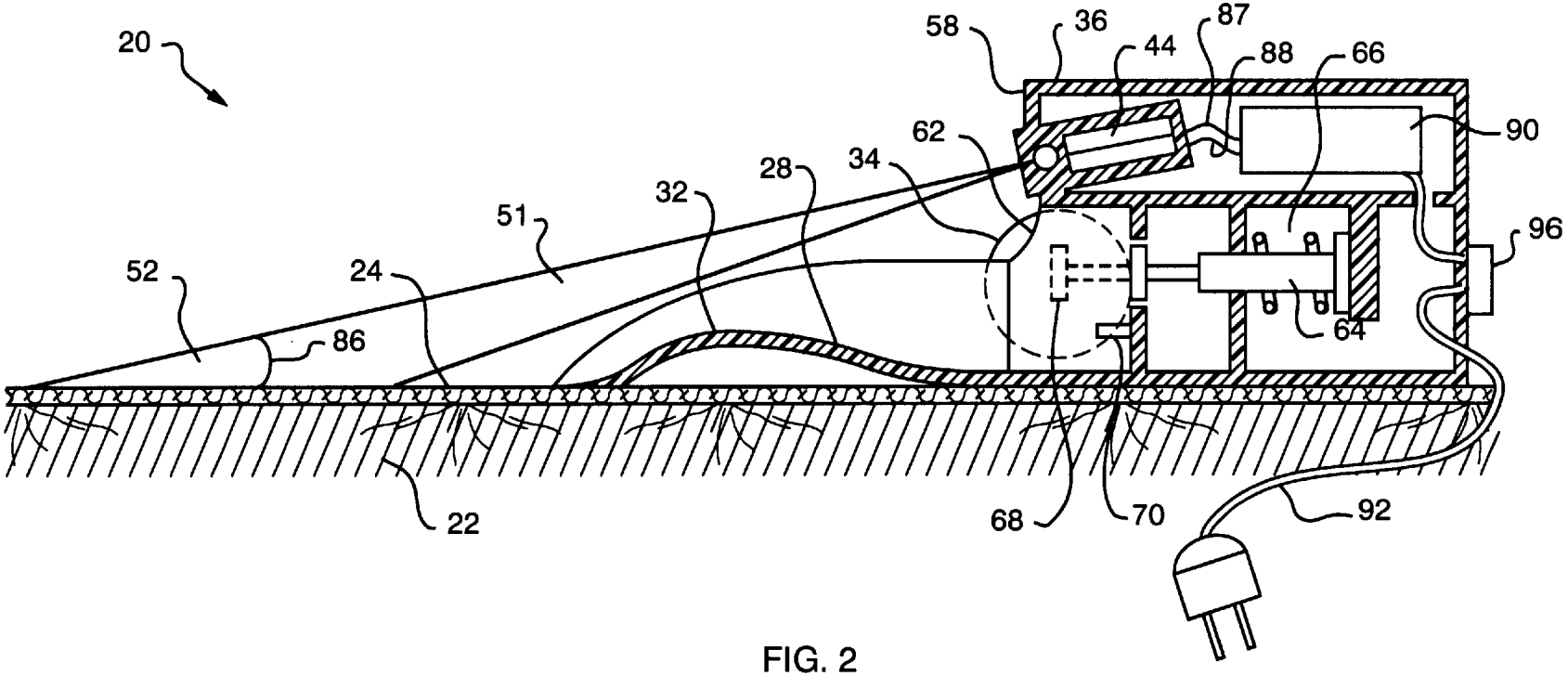
FIG. 2 is a longitudinal sectional view taken along the line 2—2 in FIG. 1.

In FIGS. 1 and 2, a housing 58 is shown in which the components comprising the device 20 are affixed. Preferably, the housing 58 is formed as a plastic molding from any one of a number of well known resinous plastic molding materials. It is also well known in the art that the molded housing 58 may be formed with cavities specifically shaped to closely receive and align the components mounted therein. Included in the housing 58 is the front ramp portion 32 extending from the carpeting 24 to a target portion 28 which simulates the golf hole 30 defined by a circularly shaped target marker 60, the diameter of which is approximately the same diameter as that of an actual golf hole. In addition, a receiving portion 62 is formed in the rear portion 36 of the housing 58 behind the target 60 and is adapted to receive a successfully aimed putt thereby preventing it from rolling past the device 20.

Typically, prior art devices also include well known electrically operated ball return mechanisms such as a spring loaded solenoid 64 located in a mounting cavity 66 formed adjacent the receiving portion 62. The solenoid 64 provides a plunger 68 extending into the receiving portion 62 which, when activated, impacts the ball 34 returning it to the golfer. Prior art ball returns also include a sensor 70 located in the receiving portion 62 which responds to the presence of the ball 34 therein thereby activating the solenoid 64. Unlike prior art devices that simply offer the golfer a target 60 at which to aim, the present invention provides not only the target 60 but also either a laser generated spot 50 or a laser generated line 52 on the practice surface 24 enabling the golfer to better visualize the location of the target 60.

Figure 3:
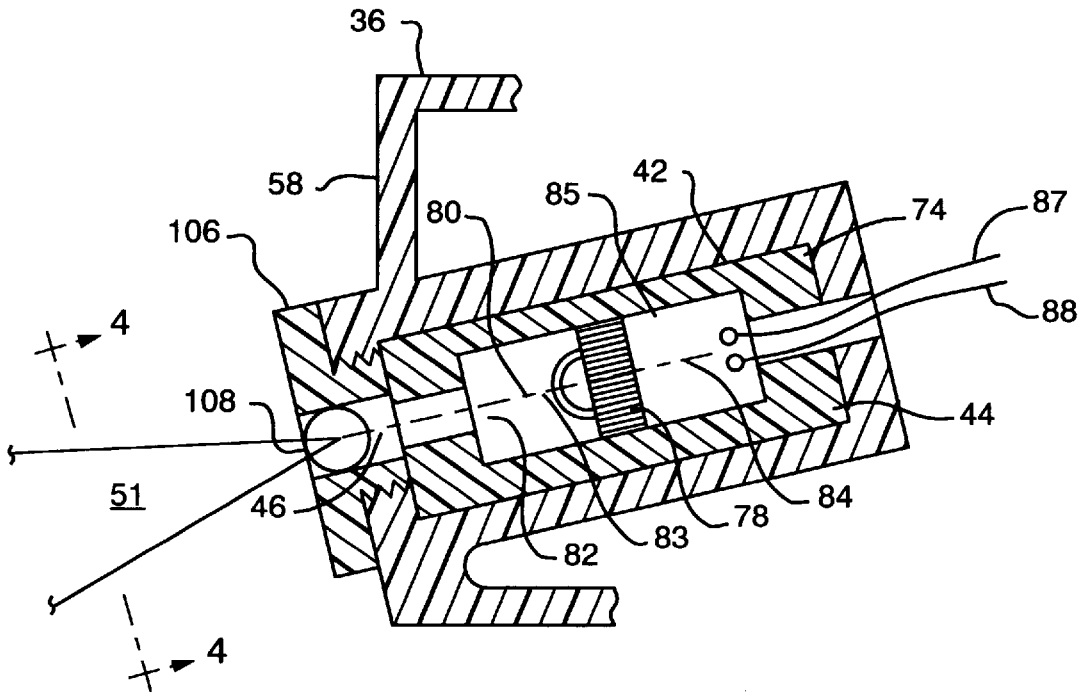
FIG. 3 is an exploded fragmentary view of the laser module included in the embodiment shown in FIGS. 1 and 2.

As shown in FIGS. 1, 2 and 3, the laser module 44, available from any one of a number of well known sources such as Lyte Optronics, Santa Monica, Calif., comprises a cylindrical housing 74 mounting therein a solid state semiconductor laser diode 78 emitting a laser beam 80, a collimating lens 82 focusing the laser beam 80 along the axis 83 of the cylindrical housing 74 and an electrical circuit 85 regulating the voltage applied to the laser diode 78. A first conductive insulated wire lead 87 and a second lead 88 connect the laser module 44 to a D.C. voltage supply 90, preferably providing between 3.0 and 4.5 volts, as required to illuminate the laser diode 78. The D.C. voltage supply 90 comprises a transformer/rectifier available from any one of a number of companies such as LZR Electronics, Inc., Gaithersburg, Md. which receives its input from a line cord 92 and produces the appropriate D.C. output voltage to energize the laser module 44. The line cord 92 may also be used to supply a voltage to the ball return solenoid 64. In addition, a switch 96, well known in the art, may be provided to offer the user the option of either turning on or turning off the laser module 44.

The laser module 44 is mounted in the rear portion 36 adjacent the target portion 28 above and behind the target 60 such that the laser beam 80 emitted by the module 44 is aimed parallel to an axially extending diameter 98 of the target hole 60 projecting forwardly thereof. The bore 42 in which the laser module 44 is mounted is formed such that the axis 84 thereof and the axis 83 of the laser module 44 are coincident and aimed at an angle 86 with respect to the surface 24 so that the laser spot 50 is projected on the surface 24 at a distance of approximately three to five feet in front of the target providing the spot 50 at an optimum distance forward of the device 20 for the practice of aiming short straight putts. As was previously mentioned, and as will be explained in more detail below, the laser beam 80 may be diffused into the thin plane of light 51 extending a substantial distance, up to at least 25 feet, in front of the target projecting a laser generated line 52 on the surface 24 defining the optimum path 48 for the practice of long putts.

Figure 4:
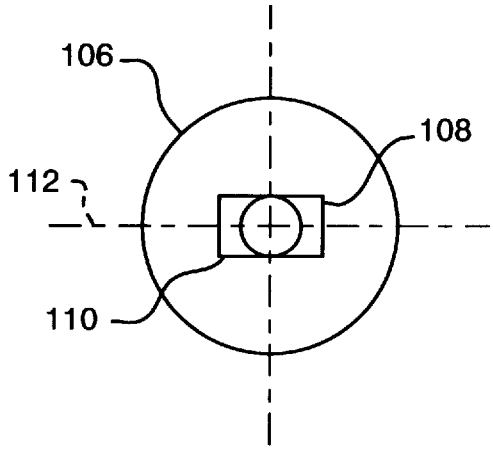
FIG. 4 is a partial front view of the laser module taken along the line 4—4 in FIG. 3.

As shown in FIGS. 3 and 4, a generally cylindrical lens holder 106 having mounted therein a cylindrical lens 108 is threadedly affixed to the housing 58 adjacent the collimating lens 82. The cylindrical lens 108 is positioned to intercept the laser beam 46 in order to optically defuse it into the thin plane of light 51. Preferably, the cylindrical lens 108 is formed from commercially available clear plexiglas rod having a diameter of approximately 0.187 inch cut to a length of 0.250 inch such that the lens 108 fits snugly into a lens cavity 110 formed in the lens holder 106. The plexiglas rod may be purchased from any one of a number of well known suppliers such as Commercial Plastics Corp., Farmingdale, N.Y. Alternatively, commonly available glass rod may be formed to the aforementioned dimensions and fit into the lens cavity 110 to difuse the laser beam 46.

Further, as shown in FIGS. 3 and 4, the longitudinal axis 112 of the cylindrical lens 108 extends in a substantially horizontal direction perpendicularly to the axis 84 of the bore 42 difusing the laser beam 46 into the thin plane of light 51 disposed in a substantially vertical direction. The golfer may use the device 20 to practice putting without threadedly engaging the lens holder 106 thus utilizing the laser spot 50 as a training aid or the golfer may use the device 20 with the lens holder 106 affixed thereto thereby utilizing the laser line 52.

Laser modules of the type mentioned above typically project a red illuminated spot 50 having a diameter of approximately 0.250 inch. At a given output power level, the color and intensity of the illuminated spot 50 depend on a number of factors two of which are the wavelength of the laser and ambient lighting conditions. A laser having an output of at least four milliwatts emitting a 670 nanometer wavelength beam is preferred for projecting the above described red spot 50 or red line 52 onto the surface 24 indoors in a normally lit room. In a brightly lit room or outdoors in sunlight, preferably, a four milliwatt laser having a 635 nanometer wavelength laser beam may be used.

It is well known that a significant number of golfers have difficulty visualizing the proper alignment of the club face with respect to the intended line of the putt. Physicians, specializing in sports medicine, recognize that many players misaim putts because their brain "sees" the target 60 in one place when it is actually in another. Two-eyed or binocular vision works best when an individual's head is level and looking straight ahead as when aiming a rifle or a pool que. When putting, the golfer is standing to the side of the ball 34 and looking down at it thereby making it difficult for the brain to use binocular vision. The present invention provides an illuminated reference mark or point on the playing surface 24 between the ball 34 to be putted and the target 60 enabling the golfer to train his or her brain to visualize the actual location of the target 60.

When employing the apparatus 20 of the present invention to practice putting, the user stands adjacent the optimum path 48 and places the golf ball 34 to be putted on the carpeting 24 such that it is visually centered on the optimum path 48. Employing either the illuminated spot 50 or the illuminated line 52 as an aiming guide, the user visually aligns the face 54 of the putter 56 perpendicularly to the optimum path 48 such that when he or she correctly impacts the ball 34, the putt is aimed to travel either over the spot 50 or along the line 52 to the target. Both provide the user a means by which to "see" the target in its actual position relative to the location of the ball 34 to be putted.

Figure 5:
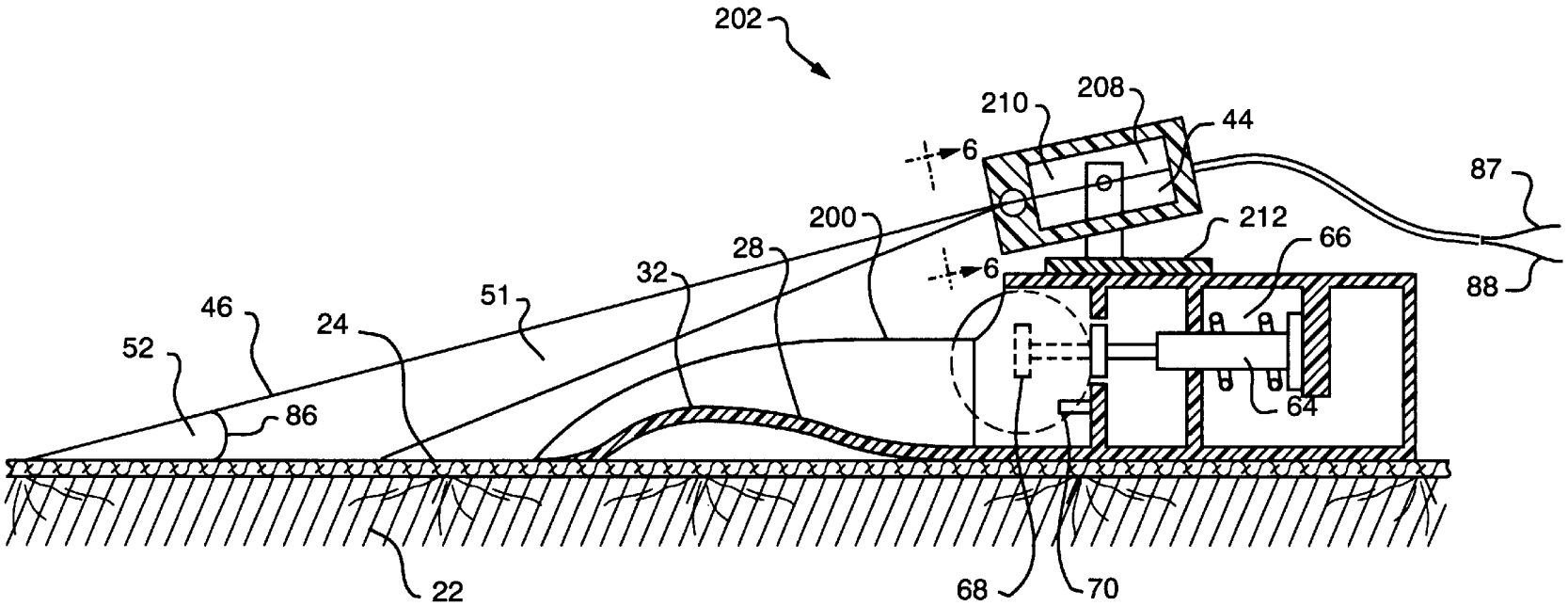
FIG. 5 is an alternate embodiment of the present invention.
Figure 6:
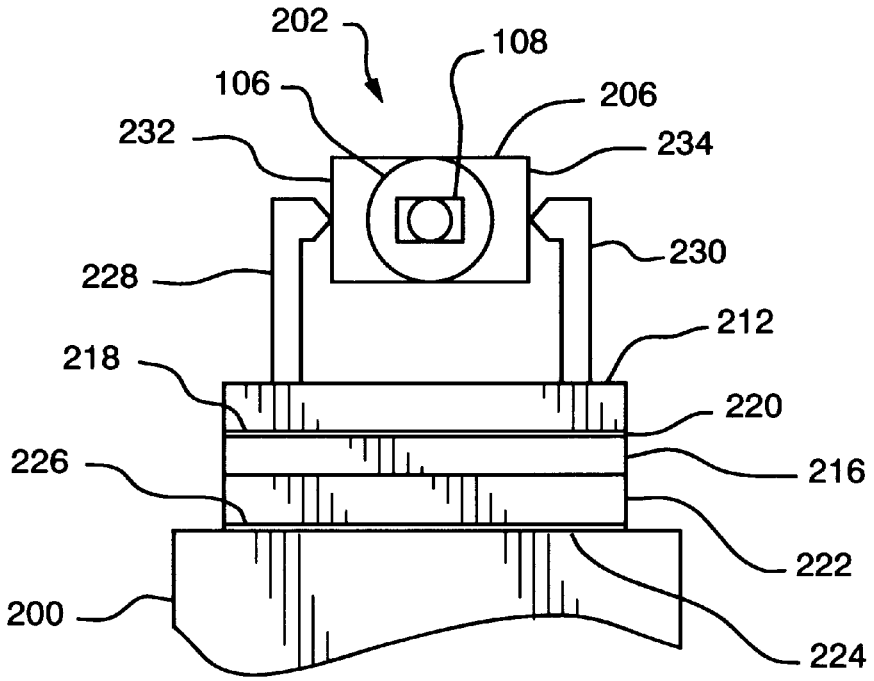
FIG. 6 is an exploded partial front view of the alternate embodiment taken along the line 6—6 in FIG. 5.

Turning now to FIGS. 5 and 6, in the drawings there is illustrated a second embodiment of the present invention offering certain variations over the previous embodiment. Principally, the laser source in the second embodiment is adapted to be removably affixed to the target portion providing the player who posesses a prior art device the opportunity of adding the laser source thereon. Further, as will be explained in more detail below, the alternate embodiment includes a laser source which is angularly adjustable in a vertical plane and, at the user's option, may be aimed at the putting surface at selected distances from the target portion.

Certain elements of the alternate embodiment are similar to and cooperate in substantially the same way as elements employed in the principle embodiment. These elements are referred to in the disclosure of the alternate embodiment by the same reference numbers used in the disclosure of the first embodiment. Further, to avoid needless repetition, the description and method of cooperation of such elements are not delineated again in the disclosure of the alternate embodiment.

In FIGS. 5 and 6, there is shown a putting apparatus 200 having removably affixed thereto a laser aiming device generally referred to by reference number 202. Positioned on the surface 24 for practicing putting thereon, the apparatus 200 incorporates certain elements which are similar to those illustrated in FIG. 1 such as the generally circular target 60 simulating the golf hole 30 defining an axially extending diameter 98. The laser aiming device 202 comprises a casing 206 forming a module bore 208 mounting therein the laser module 44 adapted to emit the laser beam 46 coincident with the axis 210 of the module bore 208.

The laser aiming device 202 also includes a base 212 which may be removably affixed to the putting device 200. A first strip of hook and pile 216 is affixed to a bottom surface 218 of the base 212 by means of a first strip of double sided adhesive tape 220 and a second strip of hook and pile 222 is affixed to the top surface 224 of the putting apparatus 202 by a second strip of double sided adhesive tape 226. The user engages the first 216 and second 222 strips of hook and pile thereby removably affixing the laser aiming device 202 to the putting device 200. As described above, the laser module 44 may be adapted by the user to project either the illuminated spot 50 or the illuminated line 52. Preferably, the user employs the illuminated line 52 when affixing the laser aiming device 202 to the device 200 in order to visually align the laser aiming device 202 with respect to the diameter 98 such that the illuminated line 52 is projected parallel to the diameter 98 in the vertical plane passing therethrough.

As shown in FIG. 6, the casing 206 is pivotably affixed to the base 212 by first 228 and second 230 pivot arms which communicate with first 232 and second 234 sides, respectively, of the casing 206. The user may adjust the direction of the device 200 in the vertical plane so that the laser beam 46 is projected toward the surface 24 at selected distances forwardly of the device 200 along the theoretical line formed by the intersection of the vertical plane passing through the diameter 92 and the generally planar surface 24.

Figure 7:
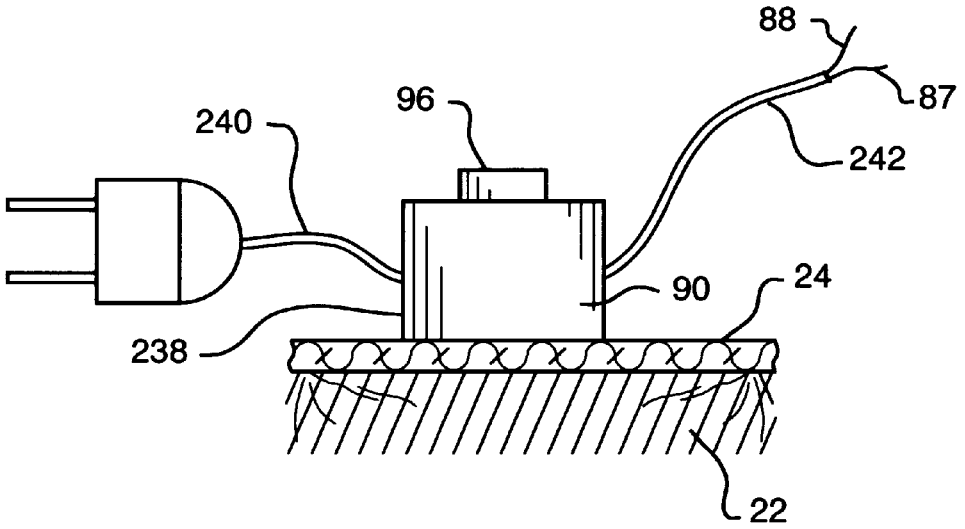
FIG. 7 is a side elevation, shown partially in section, of the power supply which provides a D.C. voltage to the embodiment shown in FIG. 6.

In the alternate embodiment, as shown in FIG. 7, the D.C. voltage supply 90 may be mounted in a voltage supply housing 238 and positioned on the playing surface 24. The supply 90 receives its input voltage through a line cord 240 and, as previously explained, transforms and rectifies the A.C. input voltage to a D.C. output voltage supplied to the laser module 44 (FIG.5) through a two conductor cord 242 having contained therein first 87 and second 88 insulated wire leads.

Figure 8:
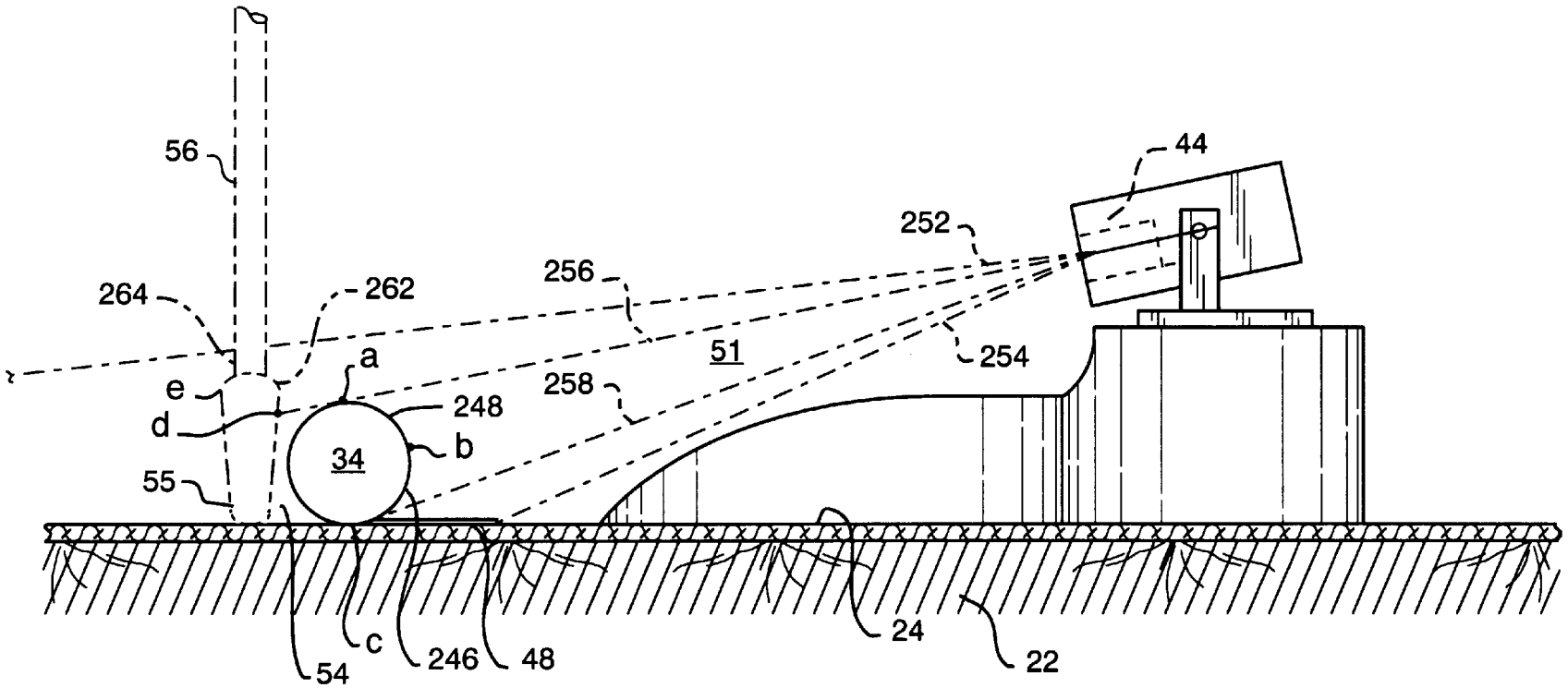
FIG. 8 is a side elevation of the embodiment of the present invention illustrating a golf ball to be putted placed in the thin plane of light emitted by the device.

As illustrated in FIG. 8, if the thin plane of light 51, bounded by an upper ray 252 and a lower ray 254, is aimed such that the ball 34 to be putted is positioned therein, a visible laser line 246 is projected on that portion 248 of the spherical surface 250 of the ball 34 which faces the laser module 44. The laser line 246 "wraps around" the ball 34 and when the vertical diametral plane of the ball 34 is coincident with the vertical plane of light 51, the laser line 246 subtends an arc (a,c) of approximately 180 degrees on the spherical surface 250 as determined by a first ray 256 and a second ray 258 contained within the thin plane of light 51 wherein the first ray 256 is tangent to the surface 250 at the point (a) and the second ray 258 is tangent at the point (c). A portion (a,b) of the arc (a,c) is clearly visible to the player addressing the ball 34 and provides an illuminated reference on the top of the ball 34 for aligning the face 54 of the putter 56 with respect to the ball 34 and with respect to the optimum path 48 which is also projected on the playing surface 24 by the plane of light 51. In addition, depending on the shape of the head 55, the thin plane of light 51 may project an illuminated centering line 262 thereon. The centering line 262 extends laterally from a point (d) on the face 54 to a point (e) on a top portion 264 which faces, without obstruction, the laser module 44. The centering line 262 further enhances the user's visualzation of a properly aligned club face 54.

It is also to be understood that the present invention is not limited to the precise details of structure shown and set forth in this specification for obvious modifications will occur to those skilled in the art to which the invention pertains.

What is claimed is:

1. A laser aiming device comprising:

a housing simulating a generally circular golf hole defining an axially extending diameter;

said housing being positioned on an adjacent floor, said floor providing a surface for putting a golf ball thereon, said golf hole providing a target for putting thereto;

said housing including a bore, the axis of said bore lying in the vertical plane containing said diameter;

a laser module mounted in said bore adapted to emit a laser beam coincident with said axis thereof; and said laser beam projecting an illuminated mark on said surface forwardly of said target thereby providing a reference means defining an optimum path of a successful putt aimed at said target.

2. A laser aiming device in accordance with claim 1 wherein said illuminated mark comprises a line projected by said laser beam on said surface extending between said target and said golf ball to be putted.

3. A laser aiming device in accordance with claim 2 wherein said line is formed by a lens positioned adjacent said laser module intercepting said laser beam emitted therefrom diffusing said beam into a thin plane of light.

4. A laser aiming device in accordance with claim 3 wherein said lens is removably affixed to said housing.

5. A device providing means for practicing proper alignment of a face of a putter with respect to an optimum path of a properly impacted golf ball, said apparatus comprising:

a target placed on a surface for putting thereon, said target simulating a golf hole for putting thereto;

a laser emitter positioned adjacent said target projecting a laser beam forwardly thereof defining an illuminated reference line on said surface for aligning said putter with respect thereto; and said golf ball to be putted being placed on said path, said face being positioned adjacent said golf ball and said face being aligned perpendicularly to said reference line such that a properly aimed putt rolls along said reference line toward said target.

6. A device in accordance with claim 5 wherein said laser beam projects an illuminated laser line onto the outside surface of said golf ball.

7. A device in accordance with claim 5 wherein said laser beam projects an illuminated centering line on a top surface of said head of said putter.

8. In combination, a laser aiming device and a putting apparatus, said apparatus simulating a generally circular golf hole defining a laterally extending diameter, said apparatus being positioned on a surface for putting thereon, said golf hole providing a target for putting thereto, said laser aiming device comprising: a casing forming a lateral bore therein; a laser module mounted in said lateral bore, said laser module adapted to emit a laser beam coincident with the axis of said bore; a base including means for removably affixing said base to said apparatus; said casing being adjustably mounted on said base and providing means for adjusting said laser beam in a vertical plane parallel to and passing through said diameter, so that said beam may be projected onto said surface at selected distances forwardly of said apparatus along a line formed by the intersection of said vertical plane and said surface; said beam providing a reference means defining an optimum path of a successful putt aimed at said target.

9. A laser aiming device in accordance with claim 8, wherein said illuminated mark comprises a spot projected by said laser beam on said surface between said target and said golf ball to be putted.

10. A laser aiming device in accordance with claim 8 wherein said illuminated mark comprises a line projected by said laser beam on said surface extending laterally between said target and said golf ball to be putted.

11. A laser aiming device in accordance with claim 10 wherein said line is formed by a lens positioned adjacent said laser module intercepting said laser beam emitted therefrom, defusing said beam into a thin plane of light.

12. A laser aiming device in accordance with claim 11 wherein said lens is removably affixed to said casing.

13. A laser aiming device comprising: a housing simulating a generally circular golf hole defining a laterally extending diameter;

Said housing positioned on an adjacent floor, said floor providing a surface for putting a golf ball thereon, said golf hole providing a target for putting thereto;

Said housing including a lateral bore, the axis of said lateral bore lying in the vertical plane parallel to and passing through said diameter;

A laser module mounted in said lateral bore adapted to emit a laser beam coincident with said axis thereof; and Said laser beam projecting an illuminated mark comprising a spot on said surface forwardly of said target thereby providing a reference means defining an optimum path of a successful putt aimed at said target.

* * * * *